US006814431B2

(12) United States Patent
Buswell et al.

(10) Patent No.: US 6,814,431 B2
(45) Date of Patent: Nov. 9, 2004

(54) SLOTTED SUBSTRATE AND METHOD OF MAKING

(75) Inventors: Shen Buswell, Monmouth, OR (US); Deanna J. Bergstrom, Corvallis, OR (US); Daniel Frech, McMinnville, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/601,149

(22) Filed: Jun. 20, 2003

(65) Prior Publication Data

US 2004/0021742 A1 Feb. 5, 2004

Related U.S. Application Data

(63) Continuation of application No. 10/210,727, filed on Jul. 31, 2002, now Pat. No. 6,666,546.

(51) Int. Cl.[7] ..... B41J 2/05
(52) U.S. Cl. ..... 347/65
(58) Field of Search ..... 347/20, 56, 61, 347/63, 65, 67

(56) References Cited

U.S. PATENT DOCUMENTS

| | | | | |
|---|---|---|---|---|
| 5,066,357 | A | 11/1991 | Smyth, Jr. et al. | 216/8 |
| 5,317,346 | A | 5/1994 | Garcia | 347/63 |
| 5,361,087 | A | 11/1994 | Tajima et al. | 347/44 |
| 5,378,137 | A | 1/1995 | Asakawa et al. | 425/174.4 |
| 5,441,593 | A | 8/1995 | Baughman et al. | 216/27 |
| 5,466,630 | A | 11/1995 | Lur | 600/461 |
| 5,588,597 | A | 12/1996 | Reinecke et al. | 347/63 |
| 5,658,471 | A | 8/1997 | Murthy et al. | 216/27 |
| 5,719,604 | A | 2/1998 | Inui et al. | 347/54 |
| 5,786,988 | A | 7/1998 | Harari | 361/749 |
| 5,820,919 | A | 10/1998 | Terai | 427/58 |
| 5,847,725 | A | 12/1998 | Cleland et al. | 347/20 |
| 5,910,679 | A | 6/1999 | Kim | 257/622 |
| 5,953,029 | A | 9/1999 | Keefe et al. | 347/65 |
| 5,988,786 | A | 11/1999 | Waller et al. | 347/63 |
| 6,020,270 | A | 2/2000 | Wong et al. | 438/719 |
| 6,106,096 | A | 8/2000 | Komplin et al. | 347/20 |
| 6,107,158 | A | 8/2000 | Zheng et al. | 438/424 |
| 6,132,033 | A * | 10/2000 | Browning et al. | 347/63 |

(List continued on next page.)

OTHER PUBLICATIONS

Aral, Kazuya, Die Cut Processing Substrate, Die Cut Substrate, and Manufacture of Die Cut Substrate, Sep. 12, 2000, 8 pages.
Momose, Kaoru et al., "Ink–Jet Type Recording Head", May 23, 2000, 11 pages.
Uenishi, Katsuzo et al., "Thermal Ink Jet Head", Jan. 11, 2000, 9 pages.
Hida; Katsuharu et al., "Manufacture of Piezoelectric Element For Ink–Jet Head", Jan. 26, 1999, 6 pages.
Nakazawa, Toshiaki et al., "Ink Jet Head", Jul. 28, 1998, 6 pages.
Miyagawa, Masashi et al., "Record Head of Ink Jet Recorder", Jun. 4, 1996, 15 pages.
Naruse, Osamu et al., "Ink Jet Head", Jan. 9, 1996, 6 pages.
Ota, Yoshihisa et al., "Ink Jet Head", Jan. 13, 1995, 5 pages.
Miyagawa, Akira, "Wiper Blade of Ink Jet Recording Apparatus", Sep. 20, 1991, 8 pages.

*Primary Examiner*—Michael S. Brooke

(57) ABSTRACT

The described embodiments relate to a slotted substrate for use in a fluid ejecting device. One exemplary embodiment includes a substrate having a thickness between generally opposing first and second surfaces. A slot received in the substrate. The slot has a central region joined with at least one terminal region. The central region extends between the first and second surfaces. The at least one terminal region includes, at least in part, a bowl-shaped portion that has a diameter at the first surface greater than a width of the central region at the first surface.

21 Claims, 10 Drawing Sheets

U.S. PATENT DOCUMENTS

| | | | | |
|---|---|---|---|---|
| 6,133,926 | A | 10/2000 | Kawai et al. | 347/63 |
| 6,142,611 | A | 11/2000 | Pan | 347/63 |
| 6,184,570 | B1 | 2/2001 | MacDonald, Jr. et al. | 257/622 |
| 6,250,738 | B1 | 6/2001 | Waller et al. | |
| 6,315,397 | B2 | 11/2001 | Truninger et al. | 347/63 |
| 6,331,055 | B1 | 12/2001 | Miller et al. | 347/92 |
| 6,348,396 | B1 | 2/2002 | Ishitsuka et al. | 438/424 |
| 2001/0023979 | A1 | 9/2001 | Brouvillette et al. | 224/231 |

* cited by examiner

SLOTTED SUBSTRATE AND METHOD OF MAKING

RELATED CASES

This patent application is a continuation claiming priority from a patent application having Ser. No. 10/210,727 titled "Slotted Substrate and Method of Making" filed Jul. 31, 2002, and issued as U.S. Pat. No. 6,666,546 B1.

BACKGROUND

Inkjet printers and other electronic printing devices have become ubiquitous in society. These printing devices can utilize a slotted substrate to deliver ink in the printing process. Such printing devices can provide many desirable characteristics at an affordable price. However, the desire for ever more features at ever-lower prices continues to press manufacturers to improve efficiencies.

One way of meeting consumer demands is by improving the slotted substrates that are incorporated into print head dies, fluid ejecting devices, printers, and other printing devices. Currently, the slotted substrates can have a propensity to crack and ultimately break. Cracking of the substrate and ultimately the print head die increases production costs as a result of lower yields and decreases product reliability.

Accordingly, the present invention arose out of a desire to provide slotted substrates having desirable characteristics.

BRIEF DESCRIPTION OF THE DRAWINGS

The same components are used throughout the drawings to reference like features and components.

DETAILED DESCRIPTION

Overview

The embodiments described below pertain to methods and systems for forming slots in a substrate. Several embodiments of this process will be described in the context of forming fluid feed slots in a substrate that can be incorporated into a print head die or other fluid ejecting device.

As commonly used in print head dies, the substrate can comprise a semiconductor substrate that can have microelectronics incorporated within, deposited over, and/or supported by the substrate on a thin-film surface that can be opposite a back surface or backside. The fluid-feed slot(s) can allow fluid, commonly ink, to be supplied from an ink supply or reservoir to fluid ejecting elements contained in ejection chambers within the print head die.

In some embodiments, this can be accomplished by connecting the fluid-feed slot to one or more ink feed passageways, each of which can supply an individual ejection chamber. The fluid ejecting elements in Thermal Inkjet (TIJ) devices commonly comprise heating elements or firing resistors that heat fluid causing increased pressure through rapid explosive boiling in the ejection chamber. A portion of that fluid can be ejected through a firing nozzle; the ejected fluid is subsequently replaced by fluid supplied from the reservoir that passes through the fluid-feed slot.

The fluid-feed slots can be configured to reduce stress concentrations on substrate material in and around the slots of the slotted substrate. In some embodiments, the slots can comprise a central region and at least one terminal region joined with the central region. In other embodiments, the terminal region can be defined, at least in part, by a bowl-shaped portion. In some of these embodiments, the bowl-shaped portion can have a diameter at a first surface of the substrate that is greater than a width of the central region at the first surface. The increased width of the terminal region can reduce areas of stress concentration by distributing stresses over a greater amount of substrate material. Other exemplary embodiments can utilize terminal regions having various other shapes that can reduce stress concentrations, especially at, or proximate to, the first and/or second surfaces of the substrate. The various slot configurations can among other attributes provide desired fluid flow characteristics and minimize stress concentration, while resulting in a stronger, more robust slotted substrate that is less prone to cracking.

Exemplary Printer System

Figure 1:
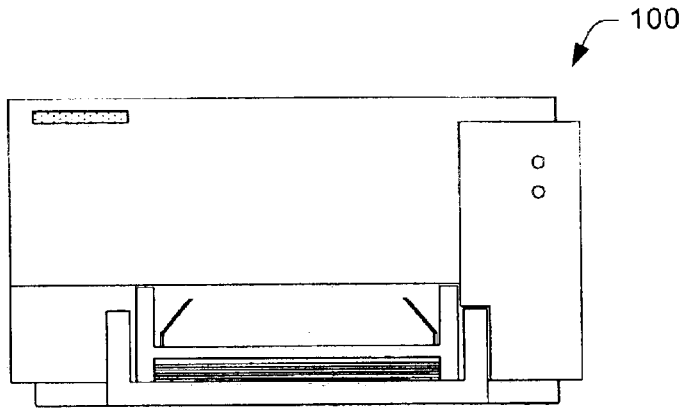
FIG. 1 shows a front elevational view of an exemplary printer.

FIG. 1 shows one embodiment of a printer 100 that can utilize an exemplary slotted substrate. The printer shown here is embodied in the form of an inkjet printer. The printer 100 can be, but need not be, representative of an inkjet printer series manufactured by the Hewlett-Packard Company under the trademark "DeskJet". The printer 100 can be capable of printing in black-and white and/or in black-and-white as well as color. The term "printer" refers to any type of printer or printing device that ejects fluid such as ink or other pigmented materials onto a print media. Though an inkjet printer is shown for exemplary purposes, it is noted that aspects of the described embodiments can be implemented in other forms of image forming devices that employ slotted substrates, such as facsimile machines, photocopiers, and other fluid ejecting devices.

Exemplary Embodiments and Methods

Figure 2:
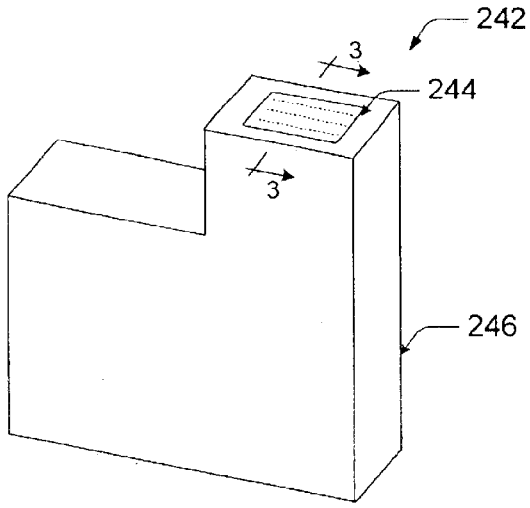
FIG. 2 shows a perspective view of a print cartridge in accordance with one exemplary embodiment.

FIG. 2 shows an exemplary print cartridge 242. The print cartridge is comprised of the print head 244 and the cartridge body 246. Other exemplary configurations will be recognized by those of skill in the art.

Figure 3:
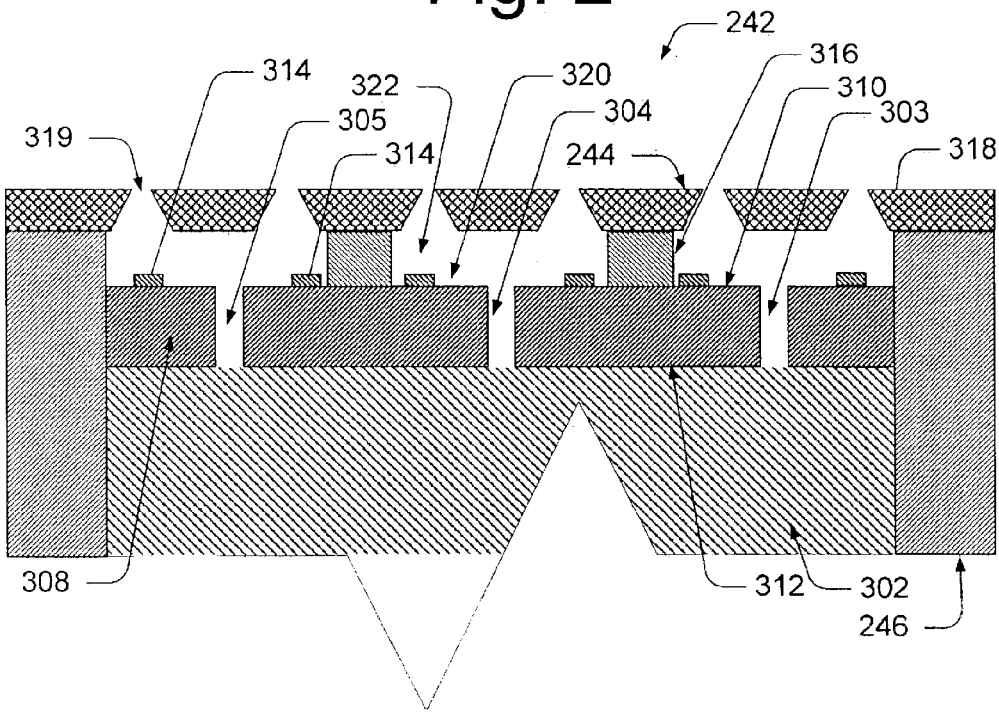
FIG. 3 shows a cross-sectional view of a top portion of a print cartridge in accordance with one exemplary embodiment.

FIG. 3 shows a cross-sectional representation of a portion of the exemplary print cartridge 242 shown in FIG. 2. It shows the cartridge body 246 containing fluid 302 for supply to the print head 244. In this embodiment, the print cartridge is configured to supply one color of fluid or ink to the print head. In other embodiments, as described above, other exemplary print cartridges can supply multiple colors and/or black ink to a single print head. Other printers can utilize multiple print cartridges each of which can supply a single color or black ink. In this embodiment, a number of different fluid-feed slots ("slots") are provided, with three exemplary slots being shown at 303, 304, and 305. Other exemplary embodiments can divide the fluid supply so that each of the three slots (303–305) receives a separate fluid supply. Other exemplary print heads can utilize fewer or more slots than the three shown here.

The various slots 303–305 pass through portions of a substrate 308. In this exemplary embodiment, silicon can be a suitable substrate. In some embodiments, substrate 308 comprises a crystalline substrate such as monocrystalline silicon or polycrystalline silicon. Examples of other suitable substrates include, among others, gallium arsenide, glass, silica, ceramics, or other semi-conducting material. Suitable substrates are commonly brittle materials for which stress concentration and profiles of slots can determine, at least in part, the strength of a part and its resistance to cracking. The substrate 308 can comprise various configurations as will be recognized by one of skill in the art.

The exemplary embodiments can utilize substrate thicknesses ranging from less than 100 microns to more than 2000 microns. One exemplary embodiment can utilize a substrate that is approximately 675 microns thick.

The functions of the substrate 308 can include mechanical (support), hydraulic (fluid delivery), and active electronic, among others. The substrate has a first surface 310 and a second surface 312. Positioned above the substrate are the independently controllable fluid ejecting elements or fluid drop generators that in this embodiment comprise firing resistors 314 that are used to heat ink. In this exemplary embodiment, the firing resistors 314 are part of a stack of thin film layers on top of the substrate 308. The thin film layers can further comprise a barrier layer 316.

The barrier layer can comprise, among other things, a photo resist polymer substrate. Above the barrier layer is an orifice plate 318 that can comprise, but is not limited to a thin nickel structure. The orifice plate can have a plurality of nozzles 319 through which fluid heated by the various firing resistors 314 can be ejected for printing on a print media (not shown). The various layers can be formed, deposited, or attached upon the preceding layers. The configuration given here is but one possible configuration. For example, in an alternative embodiment, the orifices or nozzles and the barrier layer are integral.

The exemplary print cartridge shown in FIGS. 2 and 3 is upside down from the common orientation during usage. When positioned for use, fluid 302 can flow from the cartridge body 246 into one or more of the slots 303–305. From the slots, the fluid can travel through a fluid feed passageway 320 that leads to an ejection chamber 322.

Figure 4:
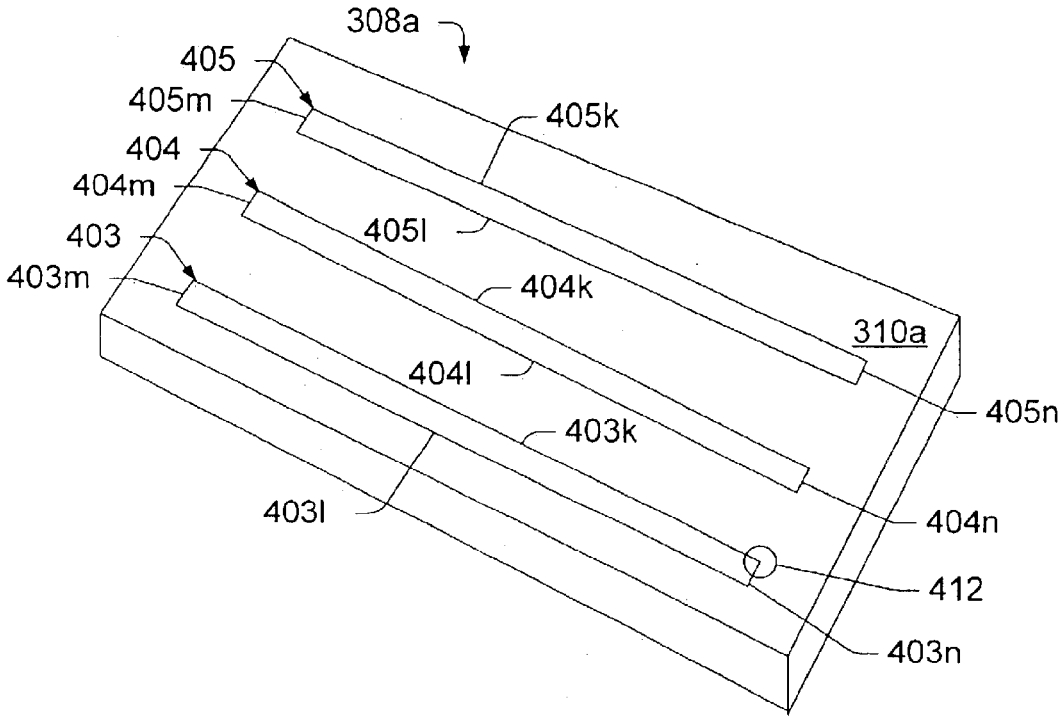
Fig. 4 Prior Art
FIG. 4 shows a perspective view of a prior art substrate.

FIG. 4 shows a prior art substrate 308*a* that has three slots 403, 404 and 405 formed therein. Individual slots can have a generally rectangular configuration when viewed from above a first surface 310*a* of the substrate. Each slot can have two sidewalls, designated "k" and "l" and two end walls, designated "m" and "n". The generally rectangular slot configuration does not optimally distribute stresses; under loading configurations. Instead stresses may be concentrated in the substrate material at the ends of the slots (403–405). The stress concentration can be particularly acute in the substrate material at a region or corner where a sidewall meets an end wall. One of these corners is designated as 412.

Figure 4A:
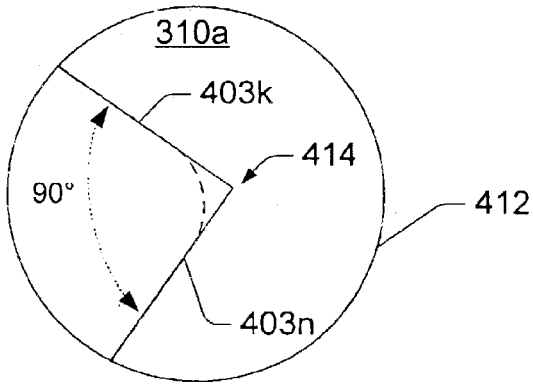
Fig. 4a Prior Art
FIG. 4*a* shows an expanded view of a portion of the prior art substrate shown in FIG. 4.

FIG. 4*a* shows an expanded view of corner 412. The end wall 403*n* is generally perpendicular to the sidewall 403*k*, and the intersection of the two walls can form an approximately 90-degree corner. Some slots can be slightly rounded at the corners (as shown in dashed lines), but still maintain the general configuration. A moderate load applied to this configuration can result in a relatively high state of stress in substrate material proximate a corner region of the slot. For example, FIG. 4*a* shows such substrate material indicated generally at 414. The stress levels at such regions can locally exceed the fracture limit of the substrate material and can cause cracking. The concentration of stress, and hence the probability of crack propagation, can be greatest for the substrate material 414 that is near the first surface 310*a* or second surface 312 (shown FIG. 3).

The portion of the substrate material 414 at, or proximate to, the first or second surfaces can be subject to high stress owing to the slot geometry and combination of compressive, tensional, and/or torsional forces, among others. Applied loads, in combination with the geometry of the corner regions, such as 414, can lead to crack initiation at these sites. Such cracks, once initiated, can propagate and ultimately cause failure of the substrate 308*a*. Since the slotted substrate is commonly incorporated into a print cartridge or other fluid ejecting device, a failure of the substrate can cause the entire component to fail.

Figure 5:
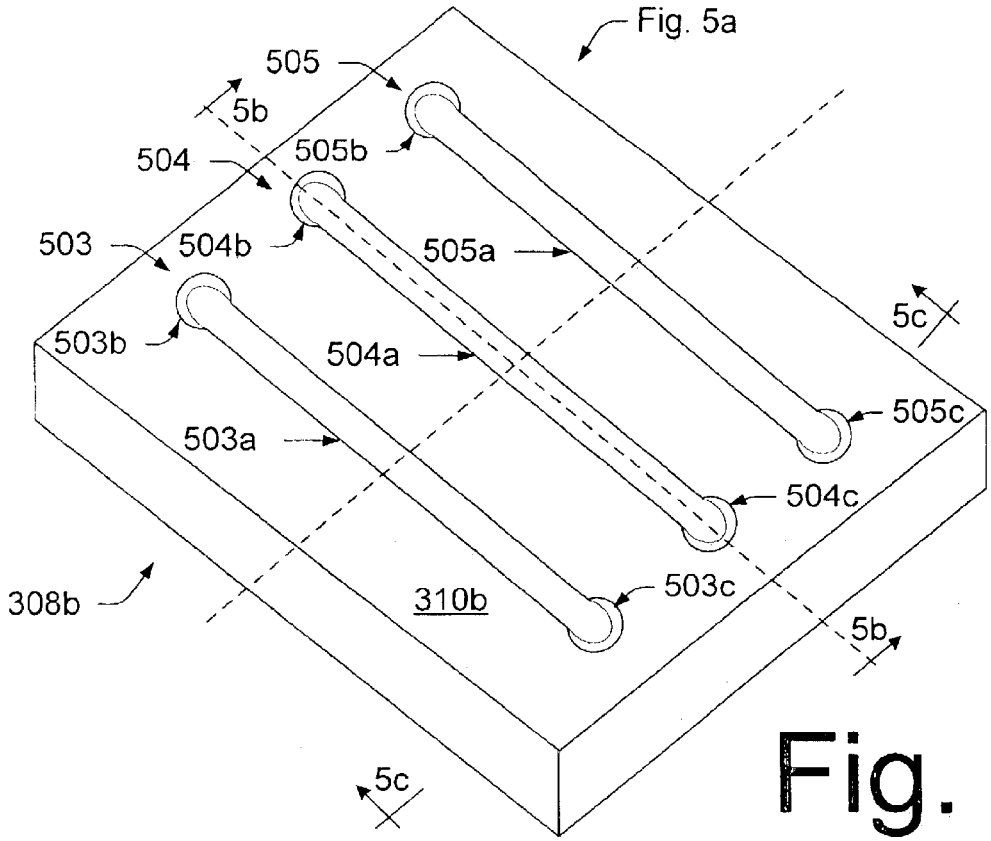
FIG. 5 shows a perspective view of an exemplary substrate in accordance with one exemplary embodiment.

FIG. 5 shows a perspective view of an exemplary slotted substrate 308*b* that can have a reduced propensity to crack. The substrate has three exemplary ink feed slots (503, 504, and 505) received in a first surface 310*b* of the substrate. In various embodiments, the first surface can comprise a thin-film surface or backside surface among others. In some of these embodiments, individual slots can have features which can reduce the substrate's propensity to crack as will be discussed in more detail below.

Individual slots 503–505 can have a central region designated "a" and at least one terminal region. As shown in this embodiment, each slot has two terminal regions designated "b" and "c". Other exemplary embodiments can have more, or less, terminal regions, some examples of which will be discussed in more detail below.

Figure 5A:
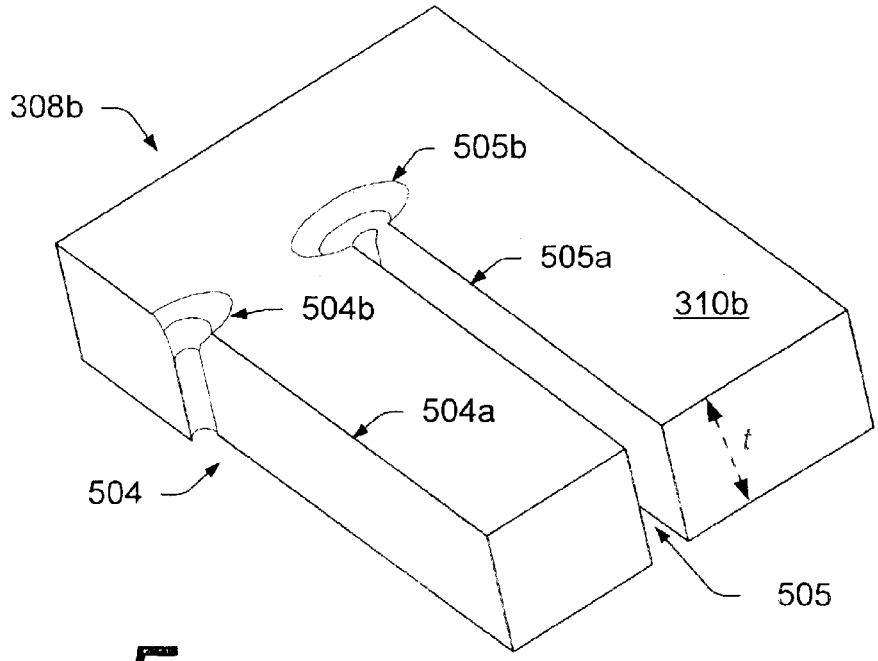
FIG. 5*a* shows an expanded view of a portion of the exemplary substrate shown in FIG. 5.

FIG. 5*a* shows an expanded cut-away view of a portion of the substrate 308*b* shown in FIG. 5. Looking specifically at slot 505, the cutaway view shows a portion of the central region 505*a* joined with the terminal region 505*b*. The terminal region, shown in this embodiment, comprises a bowl-shape, which is but one possible configuration. Other embodiments can utilize terminal regions that are generally conical, pyramidal, and frusto-pyramidal among others. In this embodiment, the surface of the terminal regions is blended or rounded into the first surface. ("Blend" as used here, means that a sharp edge has been rounded). Other exemplary embodiments can have terminal regions with a chamfered profile at the surface-to-slot wall junction and can thereby form a distinct border with a surface of the substrate.

A bowl-shaped terminal region(s) can comprise a hemisphere, or a frusto-conical shape, among others. This exemplary slot configuration can reduce stress concentrations on regions of the substrate proximate a slot. The exemplary embodiments can be especially effective at reducing stress concentrations on regions of the substrate proximate a first or second surface of the substrate and a slot. This can be achieved, at least in part, by expanding a width or diameter of the terminal region relative to the central region, thereby avoiding small radii of curvature in the slotted substrate. Such an expanded terminal region can spread any stress forces out over a greater area of the substrate material and thus reducing regions of stress concentration.

Figure 5B:
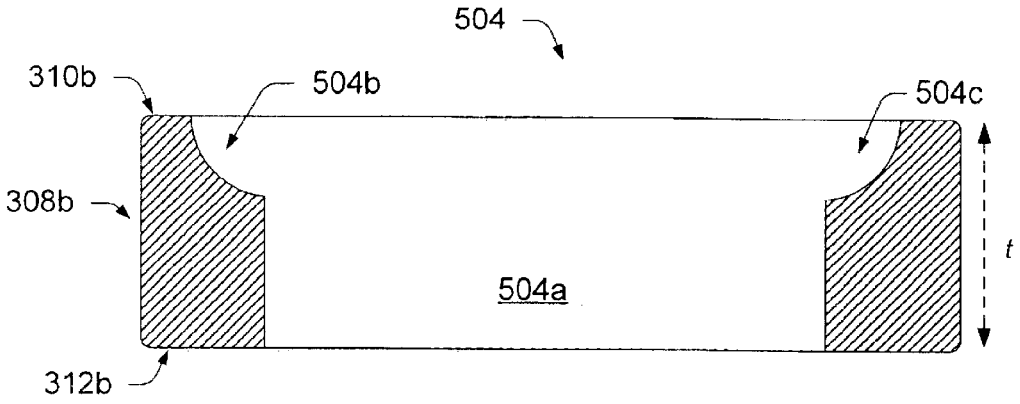
FIGS. 5*b*–5*f* show cross-sectional views of the exemplary substrate shown in FIG. 5.

FIG. 5*b* shows a cross-sectional view of substrate 308*b*. The view is taken along the long axis of slot 504, as shown in FIG. 5. The view is generally orthogonal to the first surface 310*b*. A central region 504*a* of slot 504 is formed through thickness t of the substrate extending between the first surface 310*b* and a second surface 312*b*. As shown here, most of the central region 504*a* extends through the thickness t of the substrate. Other exemplary embodiments can have less or more of the central region extending through the substrate's thickness.

Two terminal regions (504*b* and 504*c*) can be seen at opposite ends of the slot 504. As shown here, individual terminal regions do not extend through the entire thickness t of the slot. In this embodiment, the terminal regions pass through approximately 25 percent of the slot. Other exemplary embodiments can pass through less or more of the thickness of the slot. Some exemplary terminal regions can pass through a range of about 1 percent to about 100 percent of the slot's thickness. For example, some exemplary embodiments can have individual terminal regions that pass through about 10 percent to about 40 percent of a substrate's thickness. As shown in FIG. 5*b*, each of the two terminal regions (504*b* and 504*c*) passes through an essentially equivalent percentage of the substrate 308*b*, however, such need not be the case.

Figure 5C:
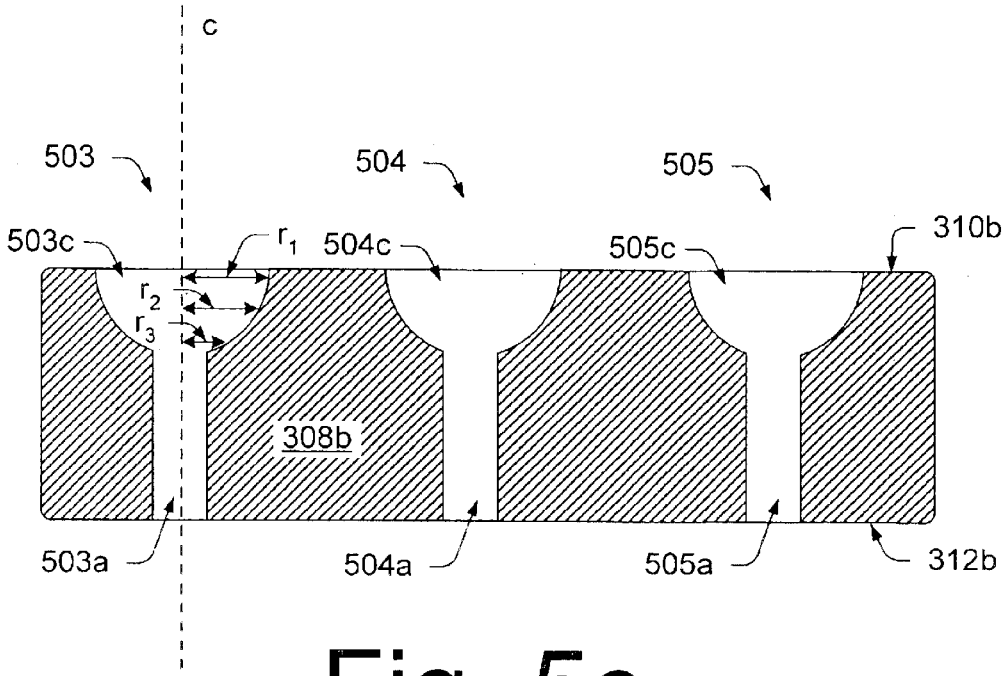

FIG. 5*c* shows another cross-section taken through the substrate 308*b* as shown in FIG. 5. In this figure, the cross-section is generally transverse a long axis of an individual slot (503, 504, and 505) and orthogonal to the first surface 310*b*. This cross-section shows three terminal regions 503*c*, 504*c*, and 505*c* this exemplary slotted substrate 308*b*.

Individual terminal regions can have many suitable configurations or shapes as discussed above. In this embodiment, the terminal regions each have a generally bowl-shaped configuration. The bowl-shape has a central axis c that in this embodiment can extend generally orthogonally to the substrate's first surface 310*b*, though such need not be the case. The bowl's perimeter can be defined, at least in part, by multiple radii each of which has a focus on the central axis c. In this orientation, the bowl's perimeter can be largest at the substrate's first surface as shown at $r_1$. The bowl's perimeter can become progressively smaller as shown at $r_2$ and $r_3$ respectively as the bowl extends into the substrate 308*b*.

In this embodiment, the central axis of the terminal region 503*c* passes through the long axis of the slot 503, however, such need not be the case, and other exemplary embodiments can be offset or have other configurations.

Figure 5D:
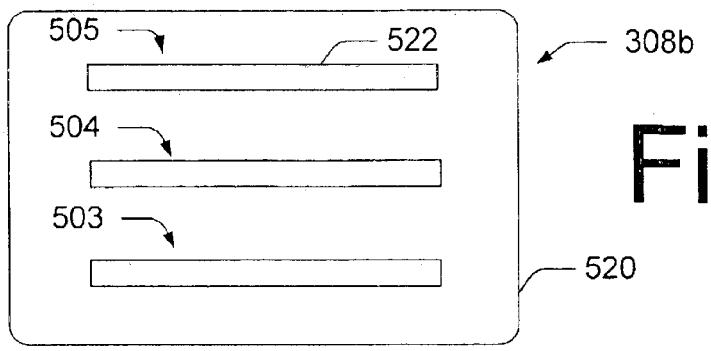
Figure 5E:
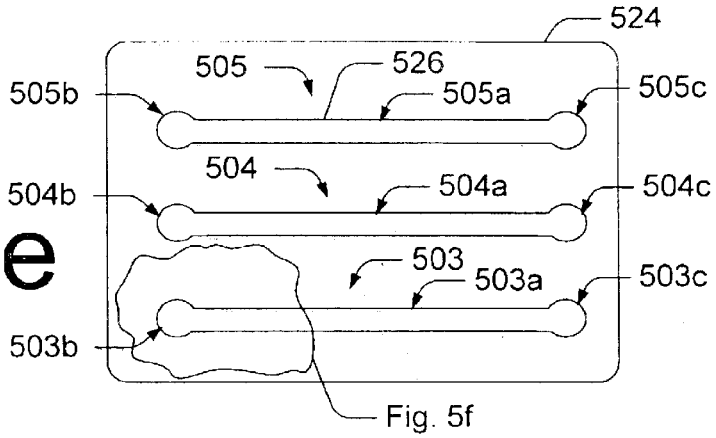

FIGS. 5*d* and 5*e* show further cross-sections of the substrate 308*b* taken at different elevational levels through the substrate and generally parallel to the first surface 310*b* (shown FIG. 5). As shown in these embodiments, the cross-sectional shape of individual slots (503–505) can vary as the slot passes through the substrate. FIG. 5*d* shows a first cross-section 520 where individual slots have a first shape 522. In this embodiment, the first shape 522 approximates a rectangle. Other exemplary embodiments can approximate a rectangle that has rounded corners, while others may be ellipsoidal, among others.

FIG. 5*e* shows a second cross-section 524 of the substrate 308*b*. The second cross-section 524 is elevationally spaced from the first cross-section 520 of FIG. 5*d*. In this example, the second cross-section 524 comprises a second shape 526. In this exemplary embodiment, the second shape 526 can comprise a central region "a" and at least one terminal region joined with the central region. Here, there are two terminal regions "b" and "c". Individual terminal regions can approximate many suitable geometric shapes, including elliptical shapes, circular shapes, rectangular shapes, and square shapes, among others. Some of these are described in more detail above and below. As shown here, the terminal regions are generally elliptical and approximate circles.

Figure 5F:
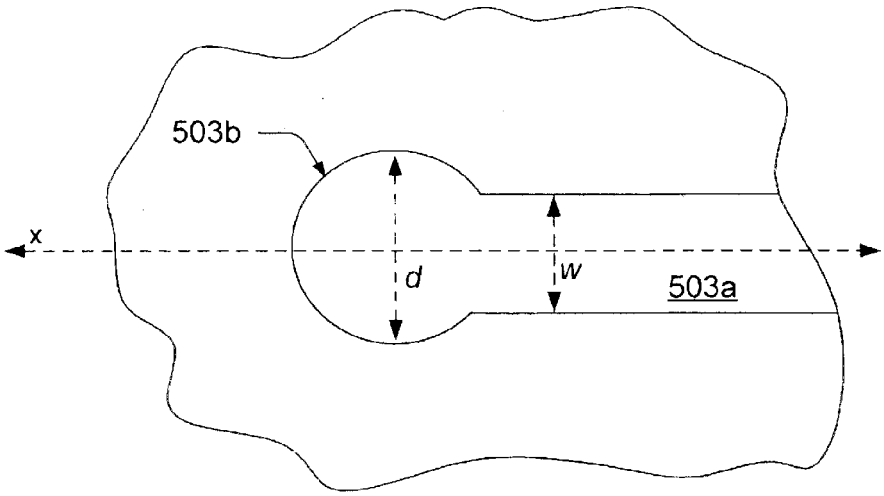

FIG. 5*f* shows an expanded view of a portion of the cross-section of slot 503, as shown in FIG. 5*e*. In this embodiment, the terminal region 503*b* can have a diameter d transverse a long axis x of the slot 503, where the diameter can be greater than the width w of the central region 503*a*.

The various exemplary embodiments can be utilized with a wide variety of slot dimensions. In some embodiments, the width w of a slot as measured at the central region can be less than about 50 microns. Other embodiments can have a width of more than about 1000 microns. Various other embodiments can have a width ranging between these values. In some embodiments, the width can be about 80–130 microns, with one embodiment having a width of about 100 microns. The total length of a slot, including the central and terminal regions can be from less than about 300 microns to about 25,000 microns or more.

Figure 6:
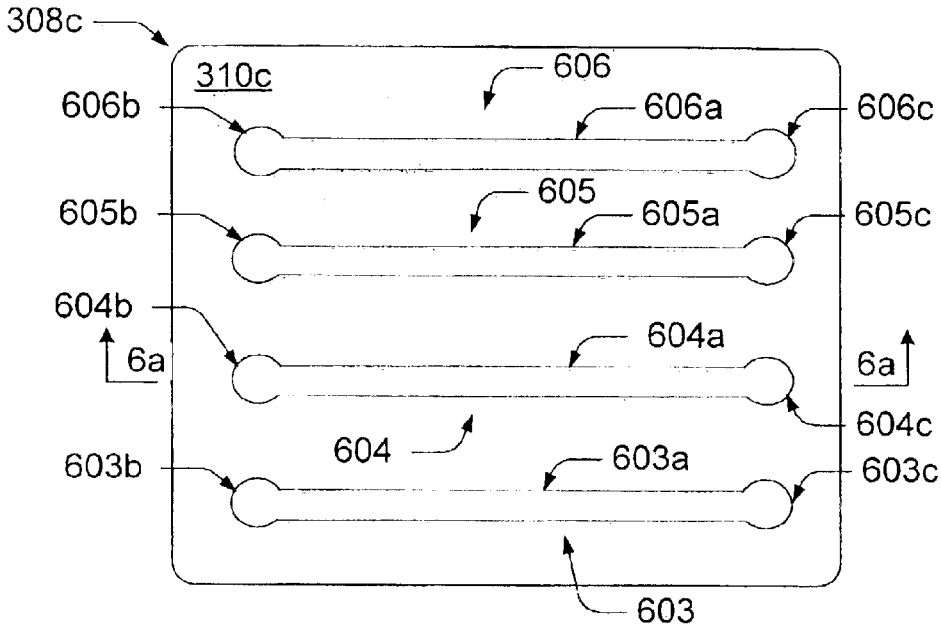
FIG. 6 shows a top view of an exemplary substrate in accordance with one exemplary embodiment.

FIG. 6 shows a further exemplary slotted substrate 308*c* in accordance with another embodiment. FIG. 6 shows a top view of a first surface 310*c* of the substrate 308*c*. The substrate has four slots formed therein (603, 604, 605, and 606). The slots are generally labeled according to the nomenclature assigned in relation to FIG. 5.

Figure 6A:
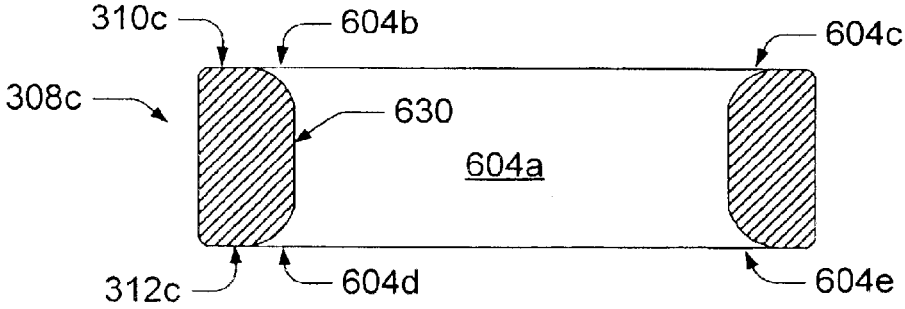
FIG. 6*a* shows a cross-sectional view of the exemplary substrate shown in FIG. 6.

FIG. 6*a* shows a cross-section of the substrate 308*c* shown in FIG. 6 and shows the central region 604*a* of slot 604 joined with two terminal regions "b" and "c" at the first surface 310*c* and two terminal regions "d" and "e" at the second surface 312*c*. This configuration can reduce crack initiation at both the first and second surfaces of the substrate. In this embodiment, the terminal regions at one end of a slot do not contact one another. For example, terminal region 604*b* and terminal region 604*d* are separated by substrate material 630 defining the central region 604*a*. In other exemplary embodiments, the terminal regions can contact or overlap one another.

Figure 7:
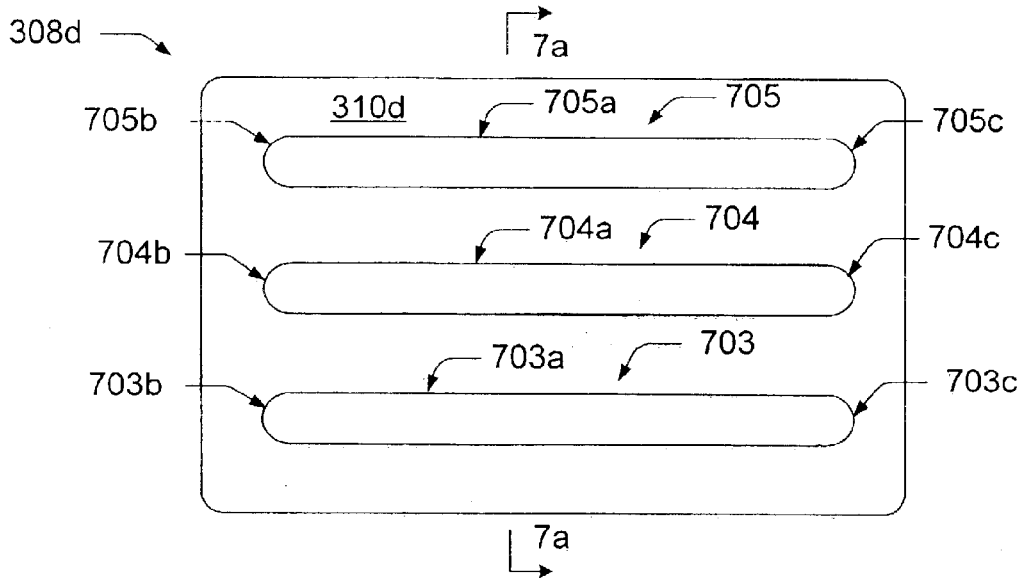
FIG. 7 shows a top view of an exemplary substrate in accordance with one exemplary embodiment.

FIG. 7 shows a first surface 310*d* of another exemplary slotted substrate 308*d*. This exemplary embodiment shows three slots (703, 704 and 705) formed in the substrate. The slots are labeled according to the nomenclature assigned in relation to FIG. 5.

Figure 7A:
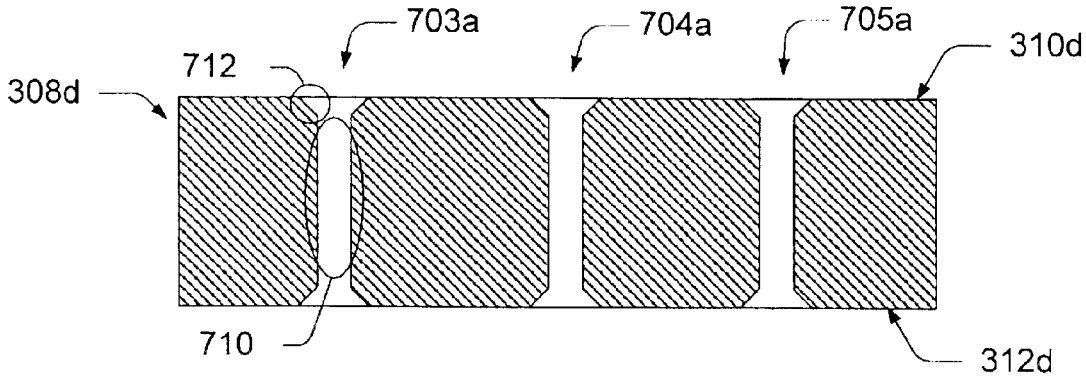
FIG. 7*a* shows a cross-sectional view of the exemplary substrate shown in FIG. 7.

FIG. 7*a* shows a cross-sectional view of the slotted substrate shown in FIG. 7. The cross-section is taken through the central region ("a") of the slots (703, 704, and 705). In the embodiment shown here, individual slots can comprise a first portion formed in the substrate. An example of such a first portion can be seen generally at 710. In some embodiments, the first portion 710 can have sidewalls that are, at least in part, orthogonal to the first surface 310*d*. Individual slots can also comprise a second portion shown generally at 712.

In the embodiment shown in FIG. 7*a*, the second portion 712 is chamfered relative to the first portion 710 and the first 310*d* or second 312*d* surface. In some embodiments, the chamfering can form a surface that is oblique relative to the first surface. In one embodiment, the chamfered surface is also oblique to the sidewalls of the first portion 710. The chamfered areas can, in some embodiments, be formed around the entire perimeter of an individual slot, though such need not be the case.

In some embodiments, the chamfered areas of the central region can match the angle or contour of one or more of the terminal regions at the first surface. In still other embodiments, the chamfered configuration can be applied to the entire slot at a first and/or second surface of the substrate. Such a configuration can further decrease the total area subject to high stress concentration that can be prone to fracture. Other exemplary embodiments can achieve similar desirable results by rounding or blending rather than, or in addition to, chamfering.

Figure 8:
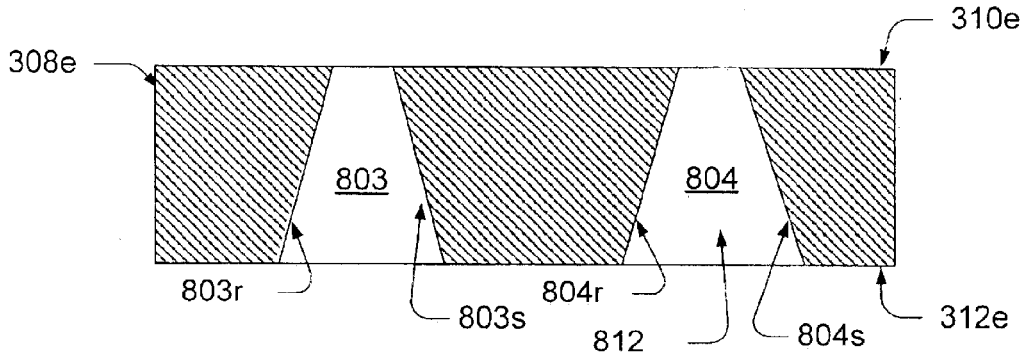
FIGS. 8–10 show cross-sectional views of an exemplary substrate in accordance with one embodiment.
Figure 9:
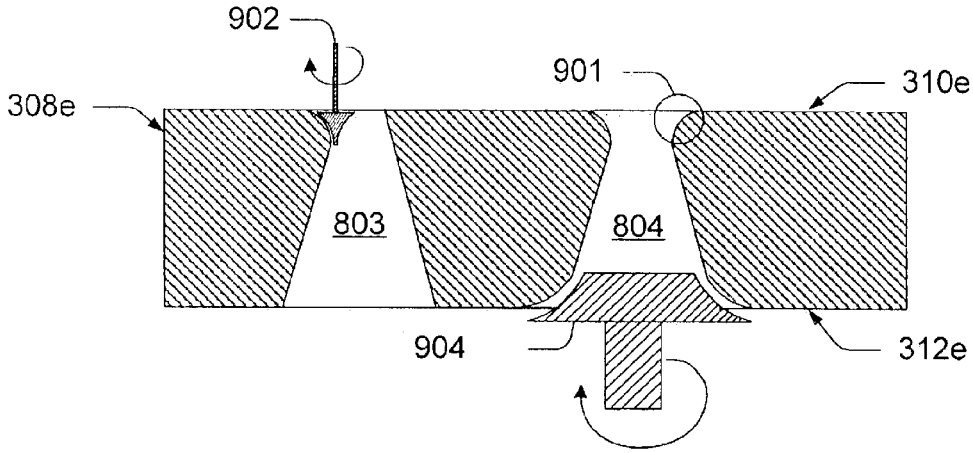
Figure 10:
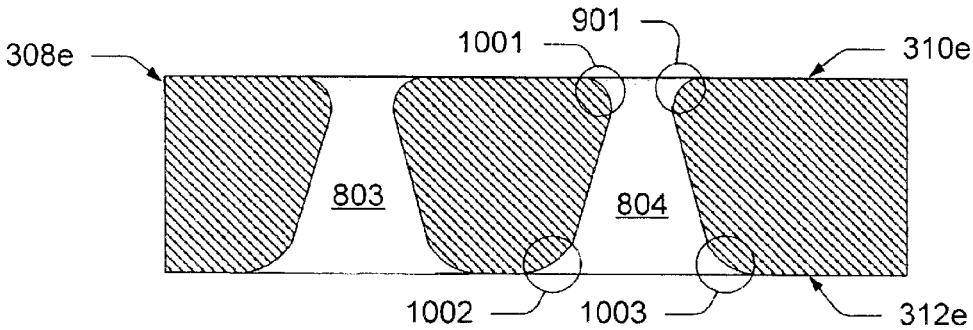

FIGS. 8–10 show cross-sectional views of an exemplary substrate in accordance with one embodiment. FIG. 8 shows a cross-section of another exemplary slotted substrate 308*e* taken transverse a long axis of individual slots (803–804) formed therein. The cross section passes through a central region of the slots. The slots (803 and 804) can be defined, at least in part, by one or more sidewalls. In this embodiment there is a pair of sidewalls designated "r" and "s". As shown here, the sidewalls (803*r–s* and 804*r–s*) are generally planar though such need not be the case. In this embodiment, the sidewalls are non-parallel. In other embodiments, some of which are described above and below, the sidewalls can be generally parallel and can be formed generally orthogonal to a first surface 310*e* of the substrate.

Exemplary slots can be formed utilizing a variety of slot formation techniques. Such techniques can include one or more of laser machining, sand drilling, mechanically removing, and etching. Mechanically removing can include various techniques such as drilling and cutting or sawing, among others. Etching can include dry etching and wet etching among others. A single technique can be used to form the slots or a combination of techniques can be used.

FIG. 9 shows the substrate 308*e* from FIG. 8, where additional substrate material has been removed (shown generally at 901, among others). In some embodiments, additional substrate material can be removed at the ends of a slot. When utilized at a slot end, such techniques can form, at least in part, a terminal region of the slot. Various suitable techniques can be used to remove the additional substrate material. Such techniques can include, but are not limited to, laser machining, etching, and mechanically removing.

In the example shown here, mechanically removing comprises removing substrate material with drill bits 902 and 904. In this embodiment, the slots (803 and 804) were formed, and then additional substrate material is removed to form the desired slot shape. In other embodiments, the order of removal can be reversed.

In another example, a drill bit, such as 902, can be run around the perimeter of the slot to form the desired shape or configuration. Alternatively, a drill bit, such as 904, can be received or advanced into the substrate and moved horizontally along a long axis of the slot. This technique can be used to form a surface that is oblique to the first or second surfaces. In a further example, a drill bit, such as 904, can remove substrate material along a substrate surface from both sides of a slot at the same time. For example, in FIG. 9, drill bit 904 can remove substrate material from both sides of the slot 804 at surface 312*e*. In some embodiments, if a single drill bit is used to remove the additional substrate material, one surface, such as 312*e*, can be completed. Either or both the substrate and/or drill bit can then be repositioned to complete the second surface.

In one embodiment, a drill bit, such as 904, can be received vertically into the substrate at one end of a slot. The drill bit can remove substrate material to form a first terminal region of the slot. The drill bit can subsequently be moved horizontally along a slot length to a second opposite end where it can form a second terminal region before being removed from the substrate. A suitable drill bit can be utilized that will form a chamfered and/or rounded profile as desired. Suitable drill bits can have various dimensions and/or configurations as desired. Suitable drill bits are available from various sources including OSG Tap & Die, INC.

FIG. 10 shows the substrate 308*e* having rounded or blended portions 901, 1001, 1002, and 1003 at both the first 310*e* and second 312*e* surfaces of slot 804. This exemplary embodiment can reduce the slotted substrate's propensity to crack by among other things dispersing stress forces experienced by particular regions of the substrate material. Various other suitable configurations can also be formed, some of which are described above and below.

Figure 11:
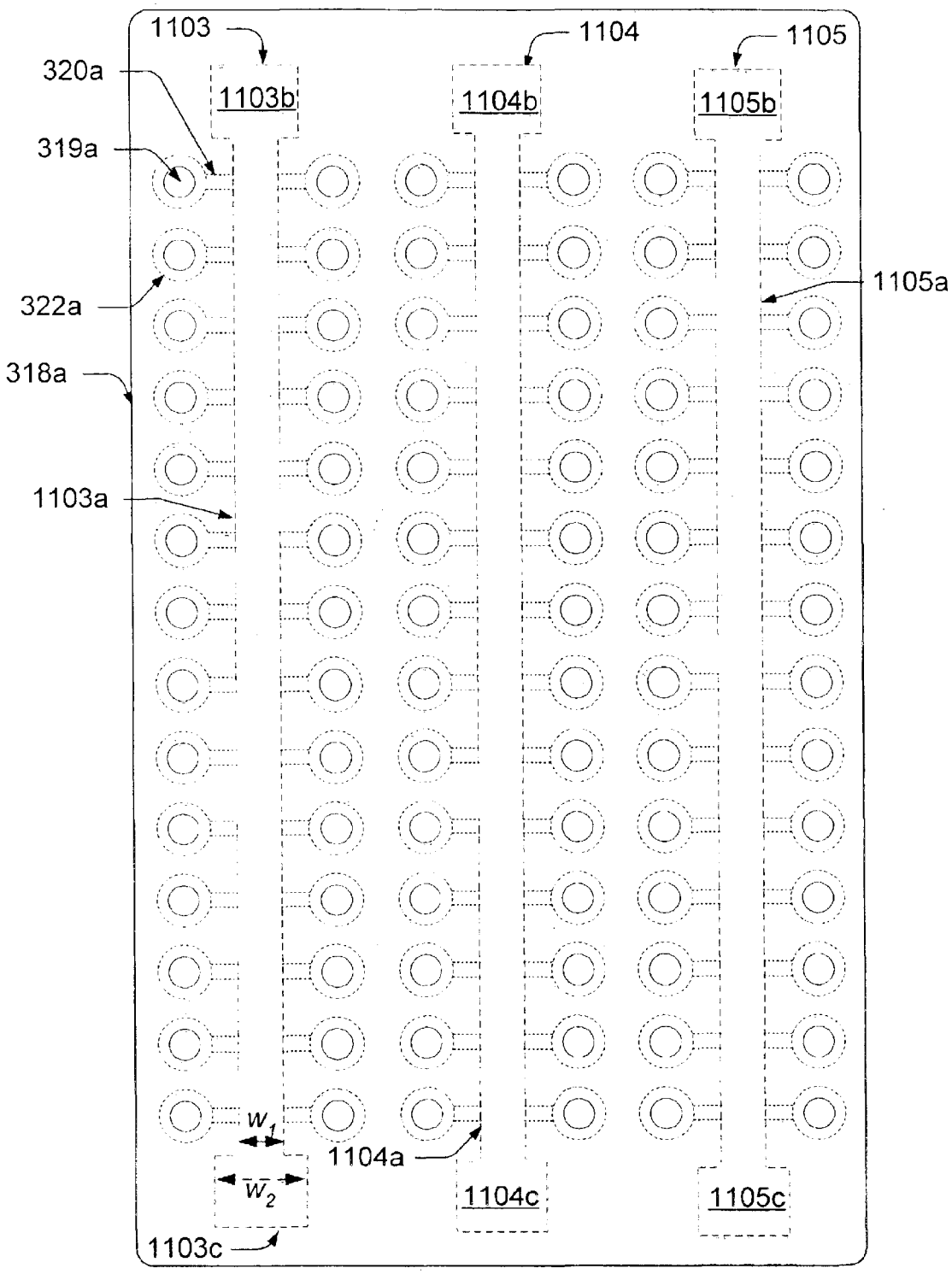
FIG. 11 shows a top view of an exemplary print head in accordance with one exemplary embodiment.

FIG. 11 shows a view from above an orifice plate 318*a* that contains multiple nozzles 319*a*. The orifice plate 318*a* is positioned over and essentially parallel to a substrate's first surface (not shown, see FIG. 3). Several underlying structures can be seen in dashed lines. The underlying features can include three slots (1103, 1104 and 1105), multiple ink feed passageways (feed channels) 320*a*, and multiple firing chambers 322*a*. The outline of the slots 1103–1105 shown here represents an exemplary slot configuration at a first surface of the substrate. These underlying structures can ultimately supply ink (not shown) that can be ejected through the nozzles 319*a* in the orifice plate 318*a*. Though this embodiment shows the firing chambers 322*a* and corresponding nozzles 319*a* being approximately equal distances from the slot, other exemplary configurations can use, among others, a staggered configuration that can enable denser packing of firing chambers to be positioned along a given slot length.

As shown in this embodiment, the slots can comprise a central region "a" and two terminal regions "b" and "c" consistent with the nomenclature described above. For example, slot 1103 can comprise a central region 1103*a* and two terminal regions 1103*b* and 1103*c*.

In this embodiment, individual terminal regions can have a generally pyramidal shape that is represented here by a square shape at the substrate's first surface. The rectangular central region can have a width $w_1$ that is less than a width $w_2$ of the terminal region where the width of the terminal region is taken along a direction essentially parallel to a direction along which the width of the central region is taken. In this embodiment the terminal regions were formed by laser machining, though other suitable processes can be utilized.

As shown in this embodiment, the firing chambers are positioned only proximate to the central region of the slots, though other exemplary embodiments can position firing chambers around more or less of the total perimeter of an individual slot.

Though the embodiments described so far have had terminal regions that are geometrically similar, other exemplary embodiments can have other configurations. For example, an exemplary slot can have one terminal region that is generally bowl-shaped and an opposing terminal end that is generally pyramidal. Alternatively or additionally, the terminal regions can have many exemplary geometrical shapes or configurations beyond those shown here. Further, although the illustrated embodiments show the terminal regions to be generally centered along a long axis of the slot such need not be the case. For example, other exemplary embodiments can have one or more terminal regions that are offset from the long axis of the slot.

Conclusion

The described embodiments can provide a slotted substrate that can have a reduced propensity to crack. The slotted substrate can be incorporated into a print head die and/or other fluid ejecting devices. The exemplary slots can supply ink to firing chambers positioned proximate the slot. The tailored topology of these exemplary slots can reduce stress concentrations that can cause substrate cracking and ultimately lead to a failure of the die. By reducing the propensity for the substrate to crack, the described embodiments can contribute to a higher quality, stronger, more robust, less expensive product.

Although the invention has been described in language specific to structural features and methodological steps, it is to be understood that the invention defined in the appended claims is not necessarily limited to the specific features or steps described. Rather, the specific features and steps are disclosed as preferred forms of implementing the claimed invention.

What is claimed is:

1. A slotted substrate for use in a fluid ejecting device comprising:

a substrate having a thickness extending between generally parallel first and second surfaces; and, a slot received in the first surface and extending along a long axis, the slot having a first cross-section generally parallel to the first surface, the first cross-section having a first shape, and the slot having a second cross-section generally parallel to the first surface and spaced from the first cross-section, the second cross-section having a second shape comprising a central region and at least one terminal region joined with the central region wherein the terminal region when measured orthogonally to the long axis of the slot is wider than the central region measured orthogonally to the long axis.

2. The slotted substrate of claim 1, wherein the first shape approximates a rectangle.

3. The slotted substrate of claim 1, where said at least one terminal region comprises two terminal regions.

4. The slotted substrate of claim 1, wherein said terminal region is elliptical.

5. A print cartridge incorporating the slotted substrate of claim 1.

6. A print head comprising:

a substrate extending between generally opposing first and second surfaces; and, a slot received in the substrate and extending along a long axis, the slot having a central region and at least one terminal region which are arranged generally along the long axis, wherein the terminal region comprises, at least in part, a bowl-shaped portion, and wherein the bowl shaped portion has a first perimeter measured along the first surface which is greater than a second perimeter of the bowl-shaped portion measured parallel to the first surface and lying between the first surface and the second surface.

7. The print head of claim 6, wherein the bowl-shaped portion has a diameter at the first surface greater than a width of the central region at the first surface.

8. The print head of claim 6, wherein the bowl-shaped portion is generally frusto-conical.

9. The print head of claim 6, wherein the bowl-shaped portion is generally hemispherical.

10. The print head of claim 6, wherein the bowl-shaped portion comprises a central axis that extends generally orthogonal to the first surface of the substrate.

11. The print head of claim 10, wherein the central axis extends through the long axis.

12. The print head of claim 6, wherein at least a portion of the central region is rounded at the first surface.

13. The print head of claim 6, wherein at least a portion of the central region is chamfered at the first surface.

14. The print head of claim 6, wherein the bowl-shaped portion has varying diameters along a central axis that is generally orthogonal to the first surface.

15. The print head of claim 6, wherein the at least one terminal region comprise two terminal regions.

16. A print cartridge incorporating the print head of claim 6.

17. A substrate having fluid handling slots comprising:

a substrate having, a thickness between generally opposing first and second surfaces;

a slot received in the substrate and having a central region joined with four terminal regions, wherein the central region extends between the first and second surfaces; and, the four terminal regions individually comprising, at least part, bowl-shaped portions, wherein two of the terminal regions are disposed proximate the first surface and the other two terminal regions are disposed proximate the second surface.

18. The substrate of claim 17, wherein when measured generally orthogonal to a long axis of the slot, the two terminal regions disposed proximate the first surface are wider at the first surface than the central region at the first surface.

19. The substrate of claim 17, wherein the two terminal regions proximate the first surface have equivalent diameters near the first surface.

20. The substrate of claim 17, wherein the terminal regions have identical shapes.

21. A print cartridge comprising, at least in part, the substrate of claim 17.

* * * * *

UNITED STATES PATENT AND TRADEMARK OFFICE

CERTIFICATE OF CORRECTION

PATENT NO. : 6,814,431 B2
DATED : November 9, 2004
INVENTOR(S) : Buswell et al.

It is certified that error appears in the above-identified patent and that said Letters Patent is hereby corrected as shown below:

Column 9,
Line 34, delete “where” and insert in lieu thereof -- wherein --;

Column 10,
Line 22, delete “comprise” and insert in lieu thereof -- comprises --;
Line 34, insert -- in -- in front of “part”.

Signed and Sealed this

Fifteenth Day of March, 2005

JON W. DUDAS
*Director of the United States Patent and Trademark Office*